United States Patent [19]

Clemente

[11] Patent Number: 4,593,737

[45] Date of Patent: Jun. 10, 1986

[54] BLIND STRUCTURE INCLUDING REMOTE SLAT MOVING MEANS

[75] Inventor: Ralph Clemente, Maywood, N.J.

[73] Assignee: RCA Corporation, Princeton, N.J.

[21] Appl. No.: 562,531

[22] Filed: Dec. 19, 1983

[51] Int. Cl.[4] ..... E06B 9/262; E06B 9/327

[52] U.S. Cl. ..... 160/84 R; 16/114 R; 49/461

[58] Field of Search ..... 160/84 R, 277, 290; 16/114 R, 114 A, 115; 49/461

[56] References Cited

U.S. PATENT DOCUMENTS

| | | | |
|---|---|---|---|
| 1,376,862 | 5/1921 | Deutsch | 16/114 R |
| 1,428,281 | 9/1922 | Eagan | 16/114 R |
| 1,794,471 | 12/1929 | Moore | 16/114 R |
| 3,082,472 | 3/1963 | Roquemore | 49/460 X |
| 3,272,547 | 9/1966 | Pryce | 16/114 A |
| 3,815,175 | 6/1974 | Szdbados | 16/114 |
| 3,946,788 | 3/1976 | van Muyen | 160/84 |
| 4,473,101 | 9/1984 | Langeler | 160/84 R |

FOREIGN PATENT DOCUMENTS

| | | | |
|---|---|---|---|
| 44519 | 10/1910 | Austria | 49/357 |
| 0015043 | 9/1980 | European Pat. Off. . | |
| 532347 | 1/1941 | United Kingdom . | |
| 1004221 | 9/1965 | United Kingdom . | |
| 1051960 | 12/1966 | United Kingdom . | |
| 1262364 | 2/1972 | United Kingdom . | |
| 2088941 | 7/1981 | United Kingdom . | |

OTHER PUBLICATIONS

"Verosol for Skylights Pleated Blinds for Awkward Situations".

"How to Install Your Gravity Pull 100 Series Verosol SkyShade".

"How to Measure for Your Gravity Pull 100 Series Verosol SkyShade".

*Primary Examiner*—Ramon S. Britts

*Assistant Examiner*—Cherney S. Lieberman

*Attorney, Agent, or Firm*—Joseph S. Tripoli; George E. Haas; William Squire

[57] ABSTRACT

A pleated fabric is connected between an upper fixed sill and a movable sill. The movable sill is between the upper fixed sill and a lower fixed sill. Strings are resiliently secured to the sills and slidably frictionally engaged with the movable sill symmetrical relative to the sills. The friction engagement tends to keep the movable sill in place at whatever location the sill is moved regardless the blind orientation relative to gravity. A projection symmetrically located on the movable sill receives an apertured connector attached to a pole. The connector closely engages the projection and movable sill for remotely moving the movable sill parallel to an axis which is symmetrical to the friction load produced by the strings. The connector transmits a force vector from the pole to the movable sill symmetrical with respect to the friction load of the strings to avoid tilting the movable sill during its movement.

3 Claims, 7 Drawing Figures

Fig. 5
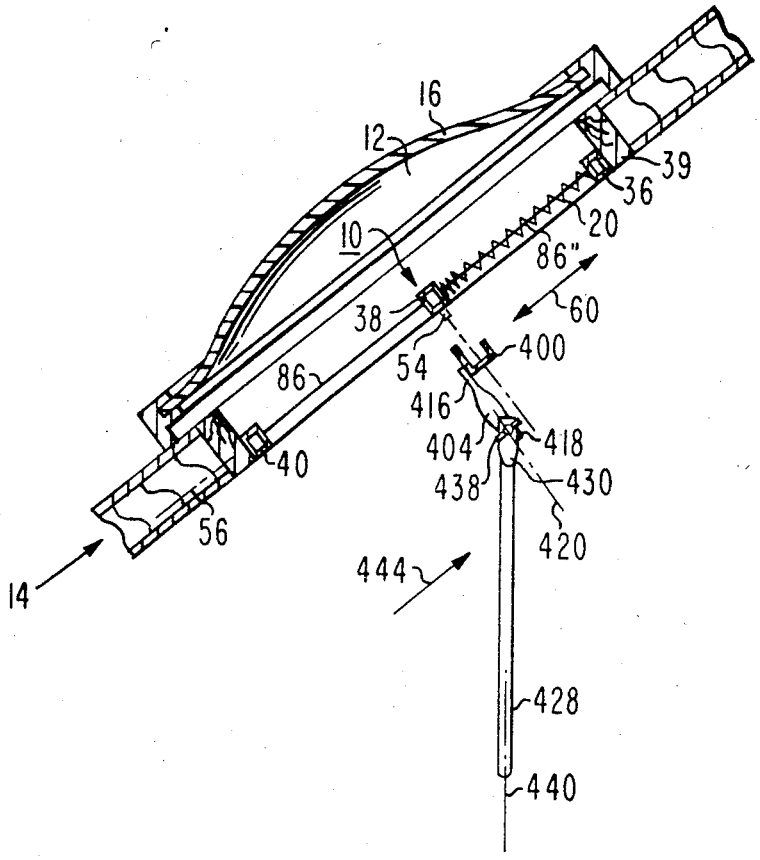
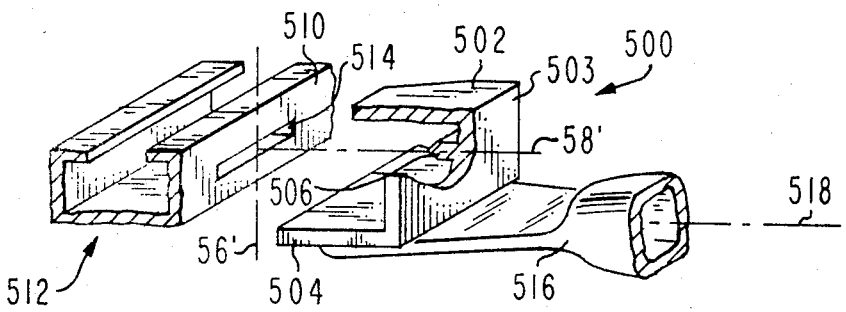
Fig. 6

BLIND STRUCTURE INCLUDING REMOTE SLAT MOVING MEANS

This invention relates to a window blind structure including means for remotely folding the slats of the blind structure.

Of interest is copending application (RCA 80,513), entitled "Blind Construction," by the present inventor, Ser. No. 562,532, filed concurrently herewith and assigned to the same assignee as the present invention.

Pleated blind structures include a relatively stiff pleated fabric which permit one end of the fabric to be moved relative to the other end. This movement folds the pleats or slats one upon the other to either open the blind for light transmission or to unfold the pleats and close the blind to reduce or eliminate light transmission through the window. U.S. Pat. No. 3,946,788 discloses a foldable curtain screen or blind construction and a method for producing a curtain blind construction employing a pleated fabric. An improvement of the pleated fabric blind construction is disclosed in European Pat. No. 0,015,043. This patent discloses friction means for retaining the pleated fabric between fully extended and fully retracted positions.

The disclosed blind structure includes an upper sill, a lower sill, and a movable sill. The pleated fabric is secured to the upper and movable sills. The upper and lower sills are secured to opposite sides of the window opening. The movable sill is displaced toward the upper sill to open the window opening, stacking or folding the slats one upon the other. A knob or other handle means is attached to the movable sill. For some windows, a person standing on a floor may grasp the knob and manually move the attached sill.

However, pleated fabric blind constructions are also employed in skylight installations. In these installations the blind structure is attached to a ceiling or roof. In that case, the blind construction cannot be reached by hand and moved from an open to a closed position. Drawstrings are often provided to access the blind for moving the slats to the desired orientation. The drawstrings, however, tend to be unsightly and require additional elements attached to the blind adding cost to the assembly.

In a pleated blind structure in accordance with the present invention including the structure described above, an improvement therewith comprises remote slat moving means including a channel-like element having a base wall and two parallel side walls, the channel of the element closely receives the movable sill member which may be rectangular in transverse section. The base wall includes means mating with force locating means, for example, the knob on the movable sill, and link means are connected to at least one of the walls for transferring a force applied to the link means to the movable sill member.

Figure 1:
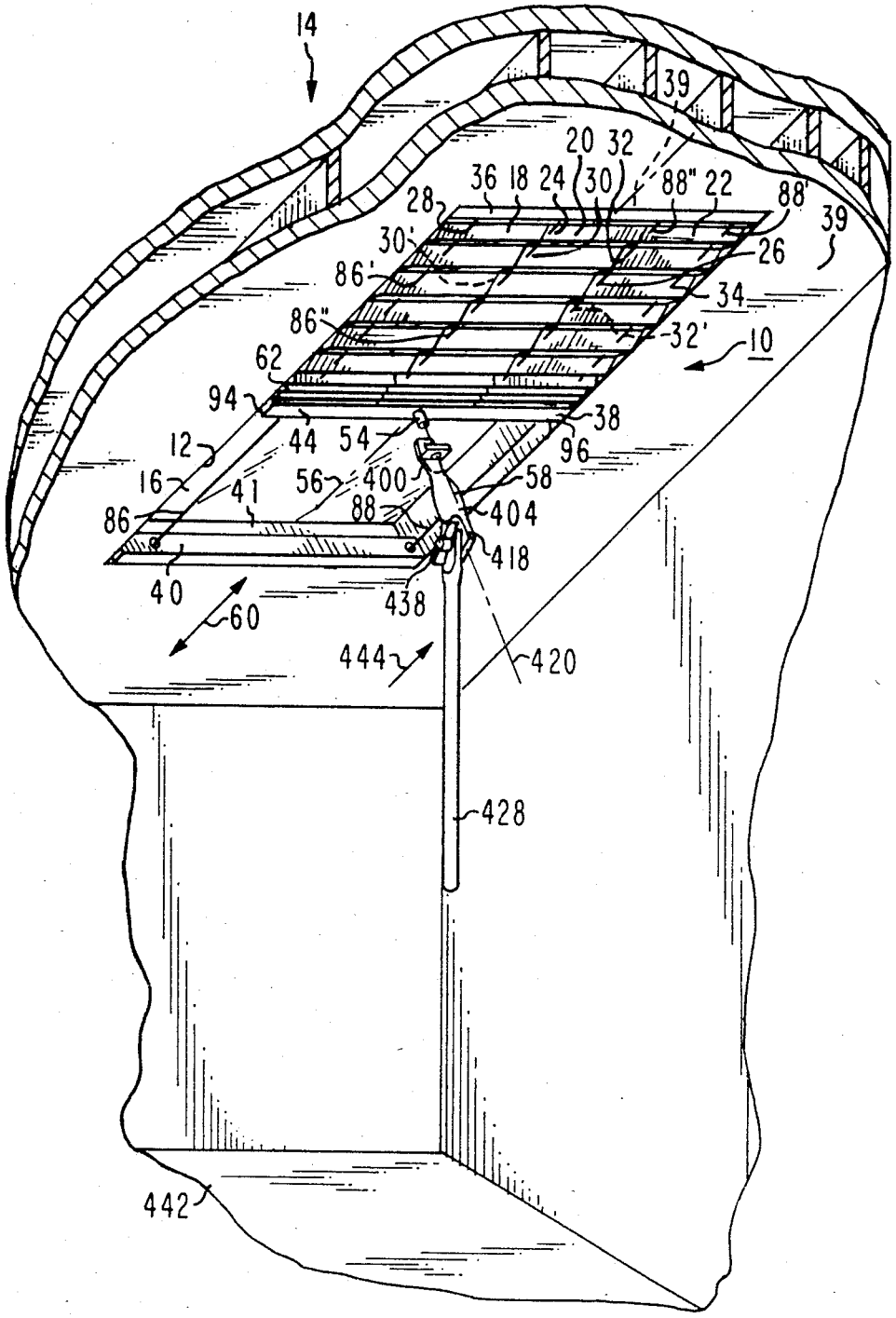
FIG. 1 is a perspective view of a skylight installation of a blind structure in accordance with one embodiment of the present invention.
Figure 3A:
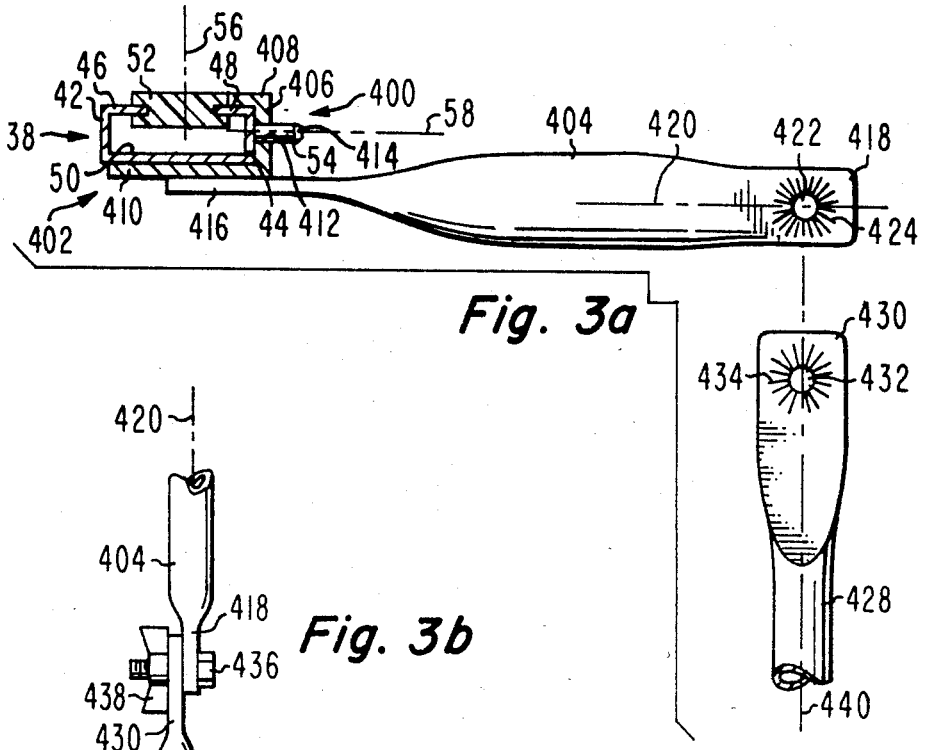
Figure 3B:
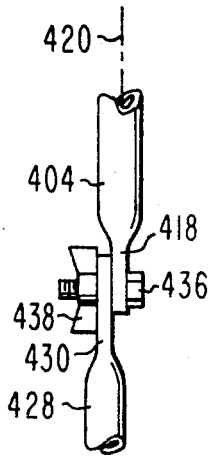
Figure 4:
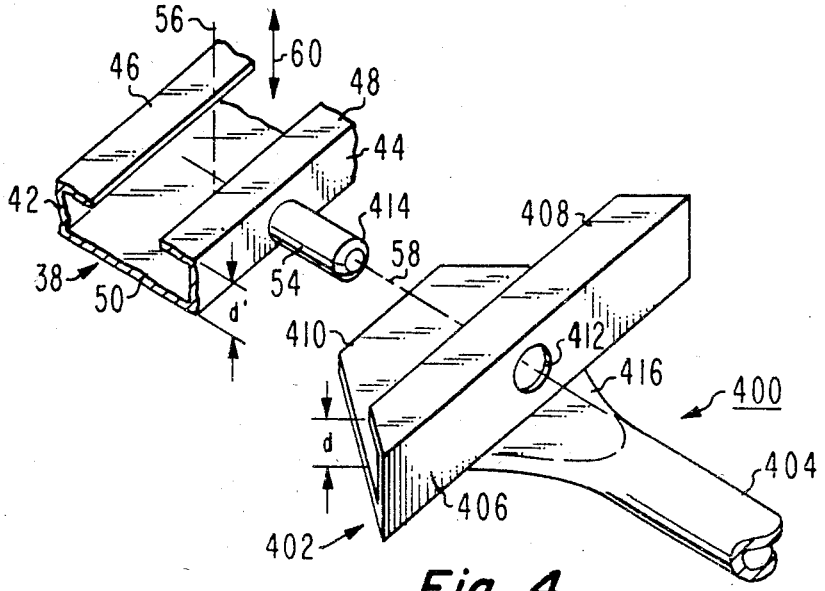

FIGS. 3*a* and 3*b* are different views of a remote slat moving means portion which can be used in the embodiment of FIG. 1;

FIG. 4 is an isometric view of a portion of the means of FIG. 3*a;*

FIG. 5 is a sectional elevation view through the embodiment of FIG. 1; and

FIG. 6 is an exploded view of a construction according to a second embodiment of the present invention.

In FIG. 1, blind structure 10 is installed in a rectangular opening 12 formed in a roof 14 of a building. The opening 12 is covered by a skylight assembly 16. Blind structure 10 may be constructed as described in the aforementioned U.S. Pat. No. 3,946,788 and European Pat. No. 0,015,043, except as modified herein, which are incorporated by reference. In somewhat similar fashion as disclosed in the aforementioned U.S. patent, the blind structure 10 may comprise a plurality of web portions, for example, portions 18, 20, and 22 which loosely overlap each other at overlapping portions 24 and 26. While three portions are shown herein, more or fewer portions may be used in the alternative. The web portions 18, 20, and 26 may be of equal or different widths and each comprise pleated relatively stiff fabrics. Each pleat forms a blind slat. The slats of web portion 18 have two columns of apertures 28, 30' and the slats of portion 20 have two columns of apertures 30, 32', and the slats of portion 22 have two columns of apertures 32, 34. Apertures 30, 30' of overlapping portions 18 and 20 are aligned. The apertures 32, 32' of overlapping portions 20 and 22 at 26 are aligned.

One end of the portions 18, 20, and 22 is secured to upper fixed sill 36 and the opposite end is secured to movable sill 38. Lower fixed sill 40 is on a side of movable sill 38 opposite upper sill 36. The upper sill 36 is secured to a header or frame 39 at one end of opening 12 and the lower sill 40 is secured to a footer or frame 41 at the other end of opening 12.

Alternatively, the pleated portions 18, 20, and 22 could be replaced by conventional Venetian blind slats with a tilting mechanism concealed in the upper sill 36.

In FIG. 3*a*, sill 38 comprises a rectangular conduit-like member having a bottom wall 50 and two side walls 42 and 44 from which respective legs 46 and 48 inwardly extend. An elongated thermoplastic sheet member 52 has two channels in opposite edges extending along its length which closely engage with and are locked to the inwardly facing legs 46 and 48. Member 52 is slid into engagement with legs 46, 48 from an open end of sill 38. In the alternative, legs 46, 48 and member 52 may be an integral member similar to wall 50. Sills 36 and 40 may be constructed similar to sill 38, which construction is representative, except for the inserts to be described below.

Sill 38 has a knob-like projection 54 extending perpendicular to wall 44. Projection 54, which may be a right circular cylinder, is centrally positioned between the ends of the sill 38 aligned on axis 56, FIG. 1. Axis 56 is parallel to directions 60 in which sill 38 is moved. Projection 54 has a long axis 58, FIG. 4, which intersects and is perpendicular to axis 56. The axis 58 may be displaced slightly from the axis 56 but is generally close to or on the axis 56. The projection 54 is perpendicular to side wall 44.

By grasping the knob 54 and manually displacing the wall 38 in one of directions 60 toward sill 36, the slats are stacked or folded, as at 62 in FIG. 1, to open the blind 10 to ambient light. Displacing the sill 38 towards sill 40 in the opposite direction, unfolds the slats to thereby close the blind and preclude transmission of light through the opening 12.

Figure 2:
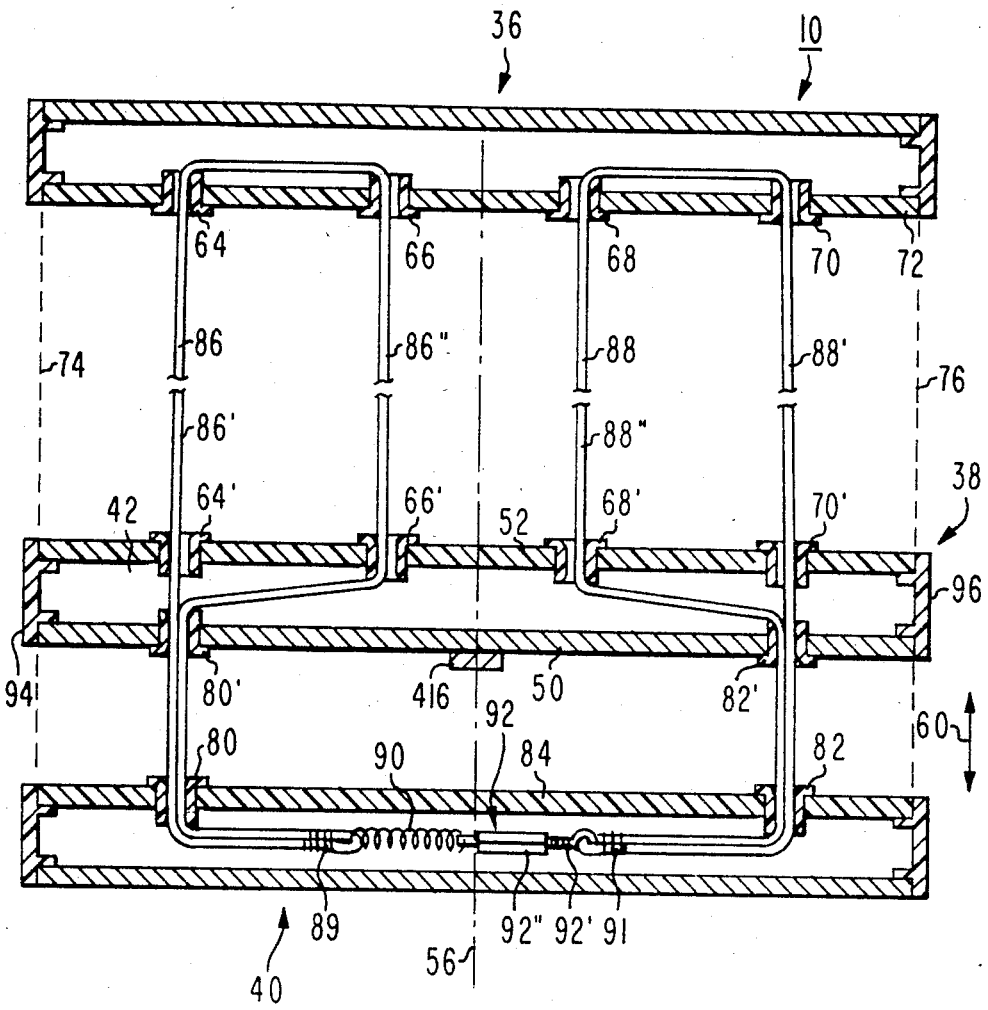
FIG. 2 is a fragmented sectional view of the blind structure of FIG. 1 illustrating the friction means.

In FIG. 2, the blind structure 10 includes friction means for retaining the movable sill 38 in any given position between the upper sill 36 and the lower sill 40. The upper sill 36 wall 72 (which may be similar to sheet member 52, FIG. 3*a*) has a plurality of like apertured inserts 64, 66, 68, and 70 which may be made of polyvinylchloride (PVC) or acrylonitrile-butadiene-styrene (ABS). The inserts 64 and 70 are closely spaced to the respective edges of the pleated fabric represented by dashed lines 74 and 76. The inserts 66 and 68 may be equally spaced between inserts 64 and 70. The insert 66 is aligned with the column of apertures 30, 30' in portions 18, 20, FIG. 1. Insert 68 is aligned with the column of apertures 32, 32' in portions 20, 22.

Lower sill 40 wall 84 (which may be similar to sheet member 52) has a pair of inserts 80 and 82 which are aligned with respective inserts 64 and 70 in a direction parallel to central axis 56. Member 52 of sill 38 has four inserts 64', 66', 68', and 70' in alignment in a direction parallel to axis 56 with respective inserts 64, 66, 68, 70 of upper sill 36. Bottom wall 50 of sill member 38 has inserts 80' and 82' aligned with the respective inserts 80 and 82 of sill 40. Inserts 64, 64' 80, 80' are aligned with the column of apertures 28 in portion 18. Inserts 70, 70', 82', 82 are aligned with the column of apertures 34. All of the inserts 64, 66, 68, 70, and so forth, may be made of the same material.

The inserts are flanged grommet-like members which snap fit into apertures in the corresponding walls of the respective sills and have central apertures therein for receiving string loops 86 and 88. Loop 86 is a closed loop formed by a string which passes through the apertures of inserts 64, 66, 64', 66', 80' and 80, and is connected to one end of tension spring 90. String loop 88 forms a closed loop formed by a string which passes through inserts 68, 70, 68', 70', 82, and 82', and is connected to the other end of tension spring 90 by a turnbuckle 92. String portion 86' of loop 86 passes through inserts 64, 64', 80', and 80. String portion 86'' of loop 86 passes through inserts 66, 66', and 80. A different string construction is shown in more detail in the European Pat. No. 0,015,043, mentioned in the introductory portion. However, that construction uses a plurality of springs.

The string construction described herein provides settable friction holding forces on the movable sill 38 at the respective inserts 80', 82', 66', and 68' and substantially the same tension on both string loops 86, 88. Loop portion 86'' bends over and around inserts 80', 66', and loop portion 88'' bends over and around inserts 68' and 82'. This bending configuration creates friction interface surfaces between the respective inserts and the strings. The tension on the strings due to the tension spring 90 induces a friction load at the friction surfaces. The tension on the strings is adjusted by the turnbuckle 92 to fine tune the amount of friction between the string loops 86, 88 and the sill 38. Loop portion 86' passes through slat apertures 28, loop portion 86'' passes through slat apertures 30, 30', loop portion 88'' passes through slat apertures 32, 32' and loop portion 88' passes through slat apertures 34, FIG. 1.

When the sill 38 is moved in directions 60, FIG. 2, it slides over the strings passing through its respective inserts and due to the friction between the strings under tension and inserts, tends to remain in place wherever pushed or moved. The web portions 18, 20, and 22 at 62 loosely slide over the loop portions as the sill 38 is moved.

Projection 54, FIGS. 1, 3*a*, and 4 is centrally located on axis 56. Axis 56 is midway between the string loops 86 and 88 which are installed in mirror image fashion relative to one another. As a result, any force applied to the projection 54 in directions 60, FIG. 2, tends to displace the sill 38 parallel to the upper and lower sills 36 and 40, respectively. Any tendency to tilt the sill 38 relative to the sills 36 and 40 by an off-center or misaligned pushing or applied force vector tends to skew the sill 38 relative to the other sills. That is, the symmetrical sliding friction loads between the strings and the movable sill 38 tend to retain the sill in the tilted orientation. This does not represent a problem for ordinary windows in which the projection 54 may be manually grasped and, thus, manually forced in the desired direction. Tilting of sill 38 can be a problem when remotely moved.

In FIGS. 3*a* and 4, apparatus 400, according to one embodiment of the present invention, is releasably attached to projection 54 and sill 38. Apparatus 400 grasps sill 38 and can accurately transmit a remotely applied force vector to sill 38 to move it in directions 60. Apparatus 400 includes channel member 402 and connecting link 404. Member 402 comprises a base wall 406 and two side walls or legs 408 and 410. Leg 410 extends from base wall 406 a greater extent than the leg 408. Centrally disposed within the base wall 406 is aperture 412. Aperture 412 has a diameter slightly larger than the diameter of projection 54 for closely receiving projection 54 on axis 58. To facilitate entry of the projection 54 into the aperture 412, end 414 of projection 54 may be conical or otherwise tapered. The spacing d between the inner surfaces of legs 408 and 410 is dimensioned to closely receive the corresponding side wall 44 of sill 38.

In FIG. 4, the insert member 52 (FIG. 3*a*) is omitted for purposes of illustration. Leg 408 of member 402 has an extent away from base wall 406 approximately the same as the width of sill leg 48. Lower leg 410 extends away from base wall 406 about the same extent as the width of wall 50 of sill 38, (FIG. 3*a*). In this way, member 402 grasps and closely engages the sill 38 at side wall 44, leg 48, and base wall 50 with negligible space and play therebetween. Thus, the projection 54 can accurately align member 402 on axis 58.

In FIG. 3*a*, the link 404 comprises a hollow aluminum tubular member which is flattened at one end to form a flange 416 and flattened at the other end to form a second flange 418. The planes of flanges 416 and 418 are perpendicular. Flange 416 is welded or otherwise secured to the underside of leg 410, member 400. The link 404 has a longitudinal axis 420 which may be parallel to axis 58. The flange 418 has an aperture 422 surrounded by radial serrations 424.

In FIGS. 3*a* and 3*b*, a pole 428 has a flange 430 formed at one end having an aperture 432 surrounded by radial serrations 434 on both sides of the flange. Flange 430 is attached to flange 418 by a bolt 436, FIG. 3*b*, secured by wing nut 438. The pole 428 has a long axis 440 which passes through the center of aperture 432. Aperture 422 is aligned centrally with axis 420 of the link member 404. Axis 440 of pole 428 may be aligned at any angle with respect to the axis 420 determined by aligned serrations 422, 434 and thus at any desired angle with respect to axis 58.

In FIG. 5, the long axis 440 of pole 428 may be vertically oriented, whereas the axis 420 of the link 404 is perpendicular to the plane of the blind structure 10 represented by axis 56. The link 404 and pole 428 form an integral rigid member. Therefore, a force, for example, in direction 444 parallel to axis 56, applied to the pole 428 by an individual standing on the floor 442, FIG. 1, is transmitted by apparatus 400 substantially in the same direction and amplitude to the sill 38. Further, that force vector is applied in directions 60 parallel to and along axis 56 due to the alignment of the apparatus 400 on the axis 56 as described above. Thus, the force is transmitted to sill 38 parallel to the axis 56 to substantially avoid skewing of the sill 38 during its displacement. Unless the force vector is applied substantially on the axis 56, that force vector can create a torque relative to the axis 56 since the string loops 86 and 88 and the friction loads that they induce when the sill 38 is moved are symmetrical about axis 56. That torque would tend to skew or otherwise tilt the sill 38 relative to axis 56. Therefore, it is critically important that the force applied to pole 428, FIG. 1, be applied to sill 38 on axis 56 or as close as possible to the axis 56 to substantially avoid such skewing and tilting. This construction of the apparatus 400, link 404, and pole 428 in conjunction with the projection 54 and its location on the sill 38 eliminate the need for using pull strings or other additional apparatus for moving the sill 38.

In the alternative, other structures may be used in the place of apparatus 400. For example, in FIG. 6 a male member 506 may be attached to the channel member 500 base wall 503. The channel member 500 base wall 506 and upper and lower legs 502 and 504 may be identical to legs 408, 410 and base wall 406 of the member 402. In this case, male member 506 is a planar projection which projects into the channel of member 500. Wall 510 of sill 512 has a slot 514 which mates with and closely receives the male projection 506. The end of projection 506 may be tapered, as shown, to allow it to be closely received within the slit 514. The slit 514 is symmetrically located on axis 56' which corresponds to the central axis of the corresponding slat structure. Slit 514 and projection 506 lie on axis 58' parallel to link 516 axis 518.

Other locating means in place of projections 54 and 506 and the mating apertures, for locating the connecting members such as members 402 and 500 to the movable sill may be employed. The important consideration is that the channel member 500 closely engages the sill 512 and the slot 514 for transmitting a force vector directly thereto without substantial deviation from the applied direction such as direction 444, FIG. 1.

What is claimed is:

1. In a blind structure comprising:

a first fixed sill member;

a movable sill member rectangular in transverse section;

a second fixed sill member; and a slat structure between and coupled to said first sill and said movable sill member, said blind structure further including friction means for retaining said movable sill member in any given orientation between said first and second sill members, and force directing means centrally coupled to said lower movable sill member for locating a force to be applied to said movable sill member to displace said movable sill member parallel to said first and second sill members, the improvement therewith comprising:

remote slat moving means including a channel-like element having a base wall and two parallel side walls, the channel of said element being sized to closely receive said movable sill member in a sill moving position from a remote location so that there is negligible space and play therebetween, said base wall including means for mating with said force directing means and for remotely releasably locking the channel-like element to the movable sill member when engaged for displacing said movable sill member whereby there is negligible motion of the slat moving means relative to the engaged sill member when the remote force set forth below is transferred; and link means connected to at least one of said walls for transferring a remote force applied to said link means to said movable sill member via said engaged slat moving means.

2. The blind structure of claim 1 wherein said movable sill member has a given length and includes two side walls and a bottom wall normal to the side walls, said force directing means including a projection extending from one of said side walls central and normal to said given length along a first axis; said channel-like element walls being adapted to closely engage corresponding ones of said sill member bottom wall and side walls, said base wall mating means comprising an aperture which mates with and receives said projection means for locating said link means at said given axis.

3. The structure of claim 2 wherein said link means includes a pole having a long axis, said link means including connector means for connecting said pole to said channel-like element, said connector means including adjustment means for angularly positioning the pole long axis at any given angle relative to said given axis in a plane normal to said given length.

* * * * *